US005548612A

United States Patent [19]

Matsuo et al.

[11] Patent Number: 5,548,612

[45] Date of Patent: Aug. 20, 1996

[54] FURNACE COVER WITH A SPRAY COOLING SYSTEM

[75] Inventors: Kunio Matsuo; Tamotsu Nomura, both of Aichi, Japan

[73] Assignee: Daido Tokushuko Kabushiki Kaisha, Japan

[21] Appl. No.: 399,988

[22] Filed: Mar. 7, 1995

[51] Int. Cl.[6] ..... F27D 1/02

[52] U.S. Cl. ..... 373/73; 373/74; 373/76

[58] Field of Search ..... 373/73, 74, 71, 373/76

[56] References Cited

U.S. PATENT DOCUMENTS

| | | | |
|---|---|---|---|
| 4,715,042 | 12/1987 | Heggart et al. | 373/74 |
| 4,813,055 | 3/1989 | Heggart et al. | 373/74 |
| 5,327,453 | 7/1994 | Arthur et al. | 373/74 |

FOREIGN PATENT DOCUMENTS 3-75493 3/1991 Japan .

*Primary Examiner*—Tu Hoang

*Attorney, Agent, or Firm*—Majestic, Parsons, Siebert & Hsue

[57] ABSTRACT

A cover with a spray cooling system for the main body of an electric furnace is of a double-layered structure with a hollow inner space in which are provided a plurality of spray nozzles such that cooling water sprayed therefrom will cool the cover. A water collecting box with one or more water outlets is attached to the outer circumferential side surface of the cover such that its bottom surface is below the bottom surface of the cover, and the interior of the box is connected to the hollow inner space of the cover such that the sprayed cooling water can be discharged without the use of a vacuum pump and does not cover the inner surface of the inner space to prevent uniform and efficient cooling of the cover.

3 Claims, 2 Drawing Sheets

FURNACE COVER WITH A SPRAY COOLING SYSTEM

BACKGROUND OF THE INVENTION

This invention relates to a cover for a furnace incorporating a spray cooling system.

Electric furnaces of various types such as electric-arc, plasma-torch and resistance heating furnaces are being used for melting and refining metals as well as for melting discarded materials. These electric furnaces are generally comprised of a main body and a cover therefor. Recently, consideration is being given to covers for such furnaces incorporating a system for spray cooling, being of a hollow double-layered structure with a space in between and provided with nozzles in this hollow space for spraying coolant such as water therethrough such that the cover can be efficiently cooled thereby. This invention relates to improved furnace covers of this type.

U. S. Pat. Nos. 4,715,042 and 4,813,055 and Japanese Patent Publication Tokkai 3-75493, for example, have recently disclosed furnace covers incorporating a spray cooling system, being of a hollow double-layered structure with a space in between and provided with a plurality of nozzles in this space and a water outlet to which a vacuum pump can be connected through a hose such that the cooling water sprayed from these nozzles into the hollow space can be forcibly removed from the interior by the pump through the water outlet and the hose. Furnace covers of this type are disadvantageous because vacuum pumps are expensive and require a large space. Moreover, the cooling of the cover becomes uneven as the furnace is used repeatedly many times, and the overall cooling efficiency is deteriorated. This is because materials such as scraps and discarded substances as well as splashed materials, slag and dust become attached and/or solidified between the main body of the furnace and the cover as the furnace is used many times, causing the cover to become sloped accordingly. If this happens, the cooling water sprayed over the inner walls of the hollow space becomes collected in a corner in the direction of which the cover is sloped and a portion of the inner wall of the hollow space becomes covered by the collected water. In this situation, the original purpose of spray cooling, which is to cool the cover by spraying cooling water thereon to thereby remove heat therefrom by heat transfer therethrough, can no longer be accomplished, and the portion of the cover where water is collected inside the hollow space cannot be cooled as efficiently as the other portions.

SUMMARY OF THE INVENTION

It is therefore an object of this invention to eliminate the disadvantages of prior art furnace covers adapted for spray cooling, requiring a vacuum pump which is costly and occupies a large space and causing unevenness in cooling after a repeated use.

A furnace cover incorporating a spray cooling system embodying the present invention, with which the above and other objects can be achieved, may be characterized not only as being of a hollow double-layered structure with an inner space in between and a plurality of spray nozzles disposed in this space for spraying cooling water therefrom and thereby cooling the cover, but also wherein there is a water collecting box which has a water discharge outlet and is attached to an external peripheral part of the cover with its bottom surface at a lower position than the bottom surface of the cover, the interior of this box being connected to the inner space of the cover. Normally, an annular water-supply header is provided inside the inner space of the double-layered structure of the cover with a plurality of water-supply pipes radially extending from this header, and the plurality of aforementioned spray nozzles are attached to these water-supply pipes. A hose is normally connected to the water discharge outlet.

A plurality of mutually partitioned water collecting boxes may be attached to the cover so as to be evenly distributed along the outer periphery of the cover with an interval between each mutually adjacent pair, but it is preferable to provide a single annular box entirely surrounding the cover. It is further preferable to make the bottom surface of such an annular water collecting box sloped by an angle which is greater than the angle by which the furnace is tilted when molten slag is poured out and in the opposite direction to the direction in which the main body of the furnace is tilted.

It is acceptable according to this invention to provide only one water discharge outlet to each of a plurality of mutually partitioned water collecting boxes or to a single annular water collecting box surrounding the cover, but it is preferable to provide a plurality of water discharge outlets evenly distributed around the outer periphery of the cover, whether one outlet to each of a plurality of mutually partitioned water collecting boxes or all to a single annular water collecting box surrounding the cover. In the case of an annular water collecting box with a sloped bottom surface, as described above, a water discharge outlet is provided at the bottom end part of the box.

At the time of an operation, a water supply hose is connected to the header and water discharge hoses are connected to the water discharge outlets. As cooling water is thus supplied to the header, it travels from the header through the water-supply pipes and the spray nozzles and is sprayed onto the inner surfaces of the inner space of the cover. After the spraying, the cooling water travels through the water collecting box (or boxes), the water discharge outlet (or outlets) and the water discharge hose (or hoses) by the force of gravity. In short, there is no need for a vacuum pump for discharging water, and even if materials such as scraps and discarded substances or splashed materials, slag and dust become attached and/or solidified between the main body of the furnace and the cover as the furnace is used many times, causing the cover to become tilted, the sprayed cooling water is collected inside the water collecting box (or boxes). In other words, the collected water does not cover any part of the inner wall of the hollow space, and the cover can continued to be cooled evenly and efficiently.

It is not always in the same direction that the cover will tilt when materials such as scraps and discarded substances or splashed materials, slag and dust become attached and/or solidified between the main body of the furnace and the cover after the furnace is used many times. This, however, does not present any problem if a plurality of mutually partitioned water collecting boxes are evenly distributed around the cover or a single annular water collecting box surrounds the cover with a plurality of water discharge outlets evenly distributed around the outer periphery of the cover, as described above.

Molten slag, generated when scraps are melted in an electric furnace, is periodically discarded through a slag outlet by tilting the main body of the furnace. The cover can be continuously cooled also during such a discarding operation if, as described above, an annular water collecting box surrounds the entire outer periphery of the cover and its bottom surface is tilted by an angle greater than the tilting angle of the main body and in the direction opposite to the tilting of the main body, with a water discharge outlet provided at the bottom end part of the bottom surface. With a cover thus structured, cooling water, after it has been sprayed, flows downward naturally by the gravitational force, even when the main body of the furnace is tilted for discarding the slag, to the bottom end of the annular water collecting box and out therefrom through the water discharge hose.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
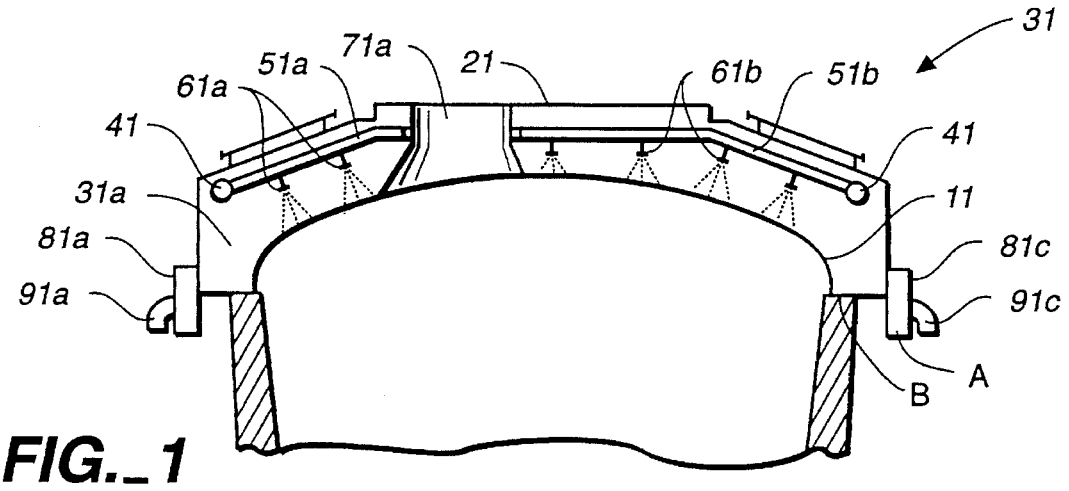
FIG. 1 is a vertical sectional view of a furnace cover according to a first embodiment of this invention.
Figure 2:
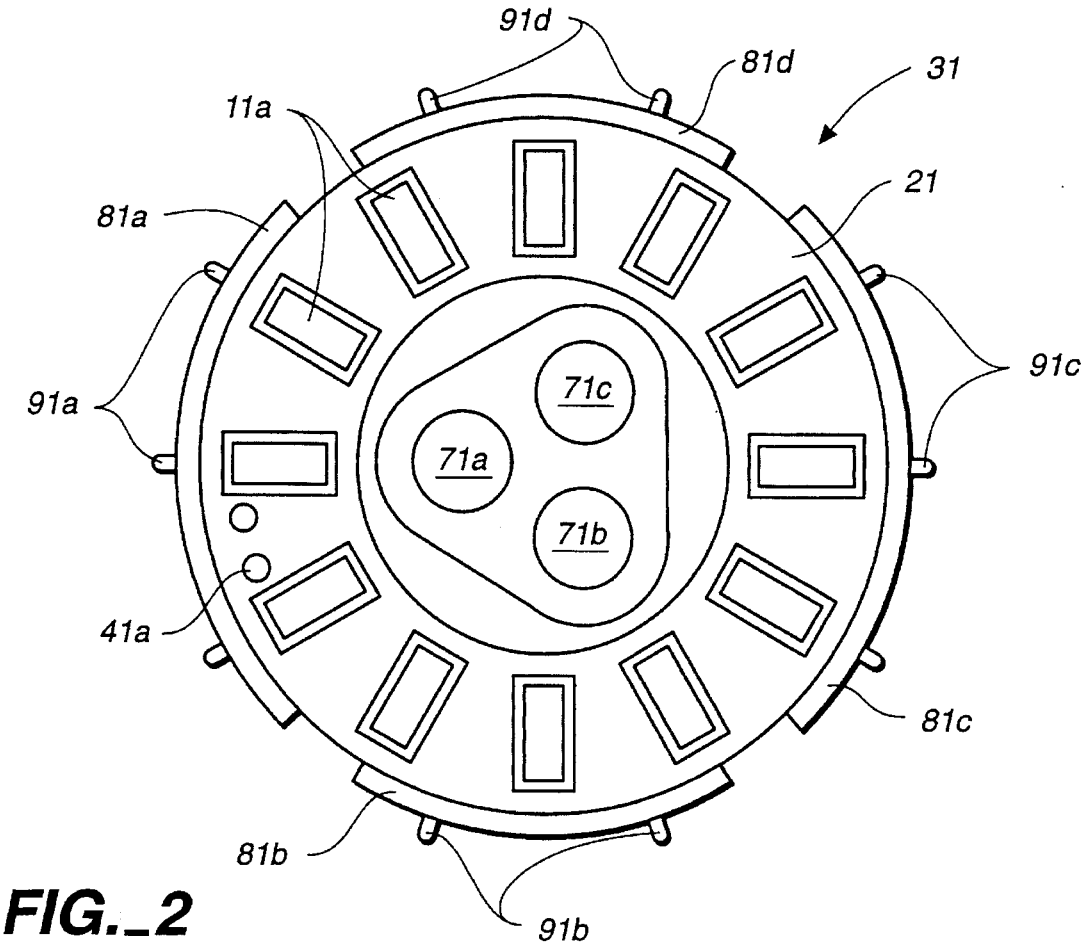
FIG. 2 is a plan view of the cover of FIG. 1.

FIGS. 1 and 2 Show a furnace cover 31 with a spray cooling system embodying this invention for a three-phase alternating current electric arc furnace. The cover is of a double-layered structure with an inner heat-resistant steel plate 11 and an outer heat-resistance steel plate 21 forming therebetween a hollow inner space 31*a* which contains therein an annular water supply header 41, a plurality of water supply pipes 51*a*, 51*b*, . . . radially connected to the water supply header 41 and a plurality of spray nozzles 61*a*, 61*b*, . . . attached to the water supply pipes 51*a*, 51*b*, . . . . The water supply header 41 and the water supply pipes 51*a*, 51*b*, . . . are supported at a plurality of positions (not shown) by the outer heat-resistant steel plate 21. The water supply header 41 has a water inlet 41*a* which penetrates the outer heat-resistant steel plate 21 and is disposed outside. Three electrode-accepting openings 71*a*, 71*b* and 71*c* penetrate a ceiling portion at a center part of the furnace cover 31. Twelve radially elongated peep-holes 11*a* opening into the hollow inner space 31*a* are provided, circumferentially distributed, to the outer heat-resistant steel plate 21.

Four separate water collecting boxes 81*a*–81*d* are attached to lower parts on the outer side surface of the furnace cover 31, evenly distributed circumferentially. The interiors of these boxes 81*a*–81*d*are connected to the hollow inner space 31*a* of the furnace cover 31, and the bottom surfaces A of the water collecting boxes 81*a*–81*d* are at a lower height than the bottom surface B of the furnace cover 31. Each of the boxes 81*a*–81*d* has two water discharge outlets 91*a*–91*d*. These outlets 91*a*–91*d* have openings below the bottom surface B of the furnace cover 31 and are evenly distributed circumferentially around the outer side surface of the furnace cover 31.

If cooling water is supplied after a water supply hose is connected to the water inlet 41*a* and water discharge hoses are connected individually to the water outlets 91*a*–91*d*, the cooling water passes sequentially through the water supply hose, the water inlet 41*a*, the water supply header 41, the water supply pipes 51*a*, 51*b*, . . . and the spray nozzles 61*a*, 61*b*, . . . and is sprayed onto the lower parts of the inner wall of the hollow space of the furnace cover 31, the sprayed water running downwards naturally by the force of gravity through the water collecting boxes 81*a*–81*d*, the water outlets 91*a*–91*d* and the water discharge hoses. In other words, there is no need for a vacuum pump or the like to forcibly discharge the sprayed cooling water. Even if materials such as scraps and discarded substances or splashed materials, slag and dust become attached and/or solidified between the main body of the furnace and the cover 31 after the furnace has been used many times, causing the furnace cover 31 to become tilted, the cooling water sprayed from the spray nozzles 61*a*, 61*b*, . . . is collected inside the water collecting boxes 81*a*–81*d* and does not cover the inner wall of the hollow inner space 31*a*. Thus, the cover 31 according to this invention can be continuously cooled efficiently by its spray cooling system as described above.

Figure 3:
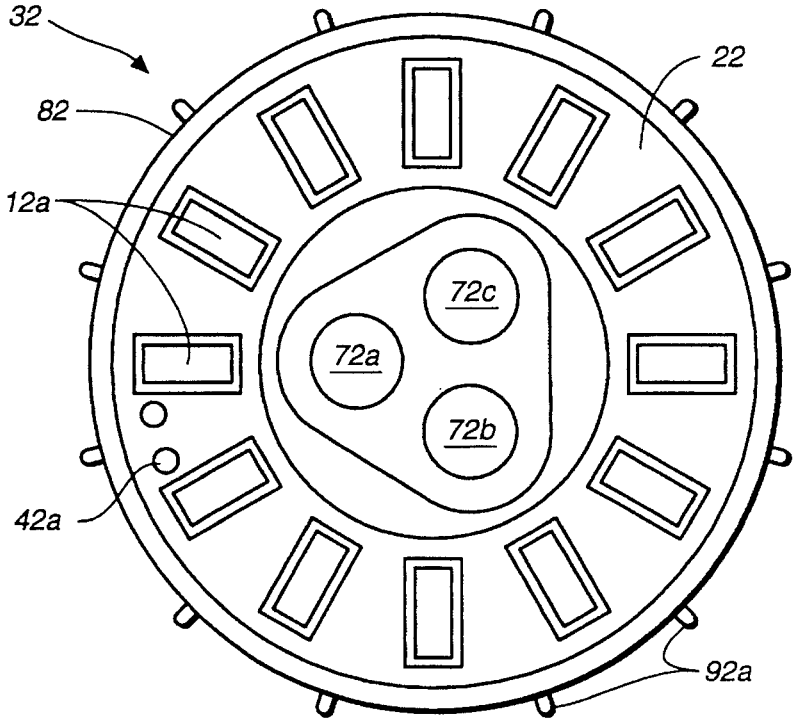
FIG. 3 is a plan view of another furnace cover embodying the invention.

FIG. 3 shows another furnace cover 32 embodying the present invention for a three-phase alternating current electric arc furnace, which is similar to the cover 31 described above with reference to FIGS. 1 and 2 in that it is of a double-layered structure with an inner plate (not shown) and an outer plate 22, both of a heat-resistant steel material and defining therebetween a hollow inner space in which are provided a water supply header, a plurality of water supply pipes radially connected thereto and a plurality of spray nozzles attached to these pipes. The water supply header and the water supply pipes are supported at a plurality of positions by the outer heat-resistant steel plate 22. The water supply header 41 has a water inlet 41*a* which penetrates the outer heat-resistant steel plate 22 and is disposed outside. Three electrode-accepting openings 72*a*, 72*b* and 72*c* penetrate a ceiling portion at a center part of the furnace cover 32. Twelve radially elongated peep-holes 12*a* opening into the hollow inner space of the cover 32 are provided, circumferentially distributed, to the outer plate 22.

The furnace cover 32 shown in FIG. 3 is different in that it is provided with a single annular water collecting box 82 circumferentially all around and at a lower position of its outer side surface such that the interior of this box 82 is connected with the hollow inner space of the cover 32. Although not shown in FIG. 3, the bottom surface of the box 82 is lower than the bottom surface of the cover 32 for the same reason as given above with reference to FIGS. 1 and 2. Twelve water outlets 92*a* are provided to the box 82 with openings below the bottom surface of the furnace cover 32 and evenly distributed circumferentially around its outer side surface.

Figure 4:
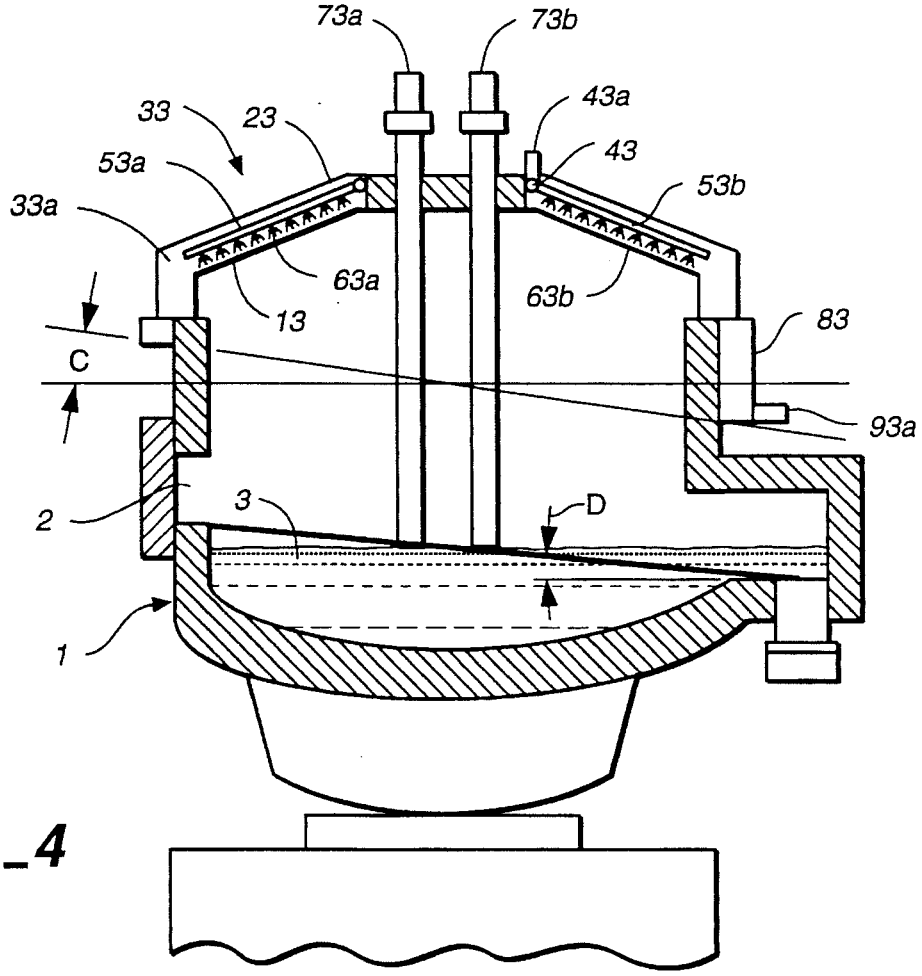
FIG. 4 is a vertical sectional view of still another furnace cover embodying the invention.

FIG. 4 shows still another furnace cover 33 embodying this invention for a single-phase alternating current electric arc furnace. It is also of a double-layered structure with an inner plate 13 and an outer plate 23, both of a heat-resistant steel material and defining therebetween a hollow inner space 33*a* in which are provided a water supply header 43, a plurality of water supply pipes 53*a*, 53*b*, . . . radially connected thereto and a plurality of spray nozzles 63*a*, 63*b*, attached to these pipes. The water supply header 43 and the water supply pipes 53*a*, 53*b*, . . . are supported at a plurality of positions by the outer heat-resistant steel plate 23. The water supply header 43 has a water inlet 43*a* which penetrates the outer heat-resistant steel plate 23 and is disposed outside. Two electrode-accepting openings penetrate a ceiling portion at a center part of the furnace cover 33. Two electrodes 73*a* and 73*b* are inserted into the furnace through these electrode-accepting openings.

An annular water collecting box 83 is attached all around the outer circumference of the bottom surface of the cover 33 such that the interior of this annular box 83 is connected with the hollow inner space 33*a* of the cover 33. The bottom surface of this annular box 83 is sloped from the horizontal by an angle C greater than the tilting angle D by which the main body (indicated by numeral 1) of the furnace is adapted to be tilted to discharge molten slag 3 therein through a slag-discharge opening 2. In FIG. 4, the slag-discharge opening 2 is shown by the tilting angle D-hand side, and the furnace main body 1 is tilted to the left to discharge the molten slag 3 therefrom. The annular box 83 is designed such that the sloping angle C of its bottom surface is greater than this tilting angle of the main body 1 and is provide with an outlet 93*a* at the lowest edge part of this sloped bottom surface. Thus, even when the furnace main body 1 is tilted for discharging the molten slag therefrom, the bottom surface of the annular water collecting box 83 sloped downwards to the right and the cooling water collected therein can be discharged therefrom through the outlet 93*a* because it remains to be at the lowest point of box 83.

In summary, no vacuum pump is necessary according to this invention for discharging used cooling water and the furnace cover can be continuously cooled evenly and efficiently.

What is claimed is:

1. A furnace cover for a main body of an electrical furnace, said cover comprising;

a double-layered structure defining therein a hollow inner space and having a bottom surface and an outer circumferential part;

a plurality of spray nozzles disposed in said hollow inner space adapted to spray coolant therethrough; and a plurality of mutually separated coolant collecting boxes attached to said outer circumferential part of said double-layered structure and adapted to collect sprayed coolant therein, each of said coolant collecting boxes having a coolant outlet and a bottom surface which is below the bottom surface of said double-layered structure.

2. The furnace cover of claim 1 wherein each of said coolant collecting boxes is annular and disposed around said circumferential part of said double-layered structure.

3. The furnace cover for a main body of an electrical furnace, said main body structured so as to be tilted by a tilting angle in a specified tilting direction for discharging molten slag therefrom, said cover comprising;

a double-layered structure defining therein a hollow inner space and having a bottom surface and an outer circumferential part;

a plurality of spray nozzles disposed in said hollow inner space adapted to spray coolant therethrough; and a coolant collecting box attached to said outer circumferential part of said double-layered structure and adapted to collect sprayed coolant therein, said coolant collecting box having a coolant outlet and a bottom surface which is below the bottom surface of said double-layered structure and is sloped opposite said tilting angle by an angle greater than said tilting angle of said main body, said coolant outlet being at a lower end part of said sloped bottom surface of said coolant collecting box.

* * * * *